US009080567B2

(12) United States Patent
Genevois et al.

(10) Patent No.: US 9,080,567 B2
(45) Date of Patent: Jul. 14, 2015

(54) SCROLL COMPRESSOR

(71) Applicant: DANFOSS COMMERCIAL COMPRESSORS, Trevoux (FR)

(72) Inventors: David Genevois, Cailloux sur Fontaine (FR); Yves Rosson, Villars les Dombes (FR); Philippe Dugast, Saint Bernard (FR)

(73) Assignee: DANFOSS COMMERCIAL COMPRESSORS, Reyrieux (FR)

( * ) Notice: Subject to any disclaimer, the term of this patent is extended or adjusted under 35 U.S.C. 154(b) by 76 days.

(21) Appl. No.: 13/863,691

(22) Filed: Apr. 16, 2013

(65) Prior Publication Data

US 2013/0272910 A1 Oct. 17, 2013

(30) Foreign Application Priority Data

Apr. 16, 2012 (FR) ..... 12 53466

(51) Int. Cl.
*F01C 1/02* (2006.01)
*F04C 18/00* (2006.01)
(Continued)

(52) U.S. Cl.
CPC ..... *F04C 18/00* (2013.01); *F01C 1/0215* (2013.01); *F01C 1/0261* (2013.01); *F04C 18/0261* (2013.01); *F04C 23/00* (2013.01); *F04C 23/008* (2013.01); *F04C 29/026* (2013.01); *F04C 29/04* (2013.01); *F04C 29/042* (2013.01); *F04C 29/045* (2013.01); *F01C 21/10* (2013.01); *F04C 18/0215* (2013.01); *F04C 23/02* (2013.01);
(Continued)

(58) Field of Classification Search
CPC .... F04C 2240/30; F04C 23/008; F04C 23/00; F04C 29/04; F04C 29/045; F04C 29/042; F04C 29/026; F04C 18/00; F04C 18/0215; F04C 23/02; F04C 18/0261; Y10S 417/902; F01C 1/0261; F01C 1/0215
USPC ..... 418/55.1–55.6; 417/371, 366, 902, 368, 417/410.5
See application file for complete search history.

(56) References Cited

U.S. PATENT DOCUMENTS

| | | | | |
|---|---|---|---|---|
| 7,311,501 | B2 | 12/2007 | Wehrenberg et al. | |
| 7,699,589 | B2 * | 4/2010 | Terauchi et al. | 418/55.5 |
| 2003/0063986 | A1 | 4/2003 | Ginies et al. | |

FOREIGN PATENT DOCUMENTS

FR 2 885 966 A1 11/2006

OTHER PUBLICATIONS

Dec. 17, 2011 Search Report issued in French Application No. 1253466.

*Primary Examiner* — Kenneth Bomberg
*Assistant Examiner* — Wesley Harris
(74) *Attorney, Agent, or Firm* — Oliff PLC

(57) ABSTRACT

The compressor includes a sealed enclosure containing a compression stage, an electric motor having a stator provided with a first and second end windings, an intermediate casing surrounding the stator so as to define an annular outer volume with the sealed enclosure, connecting means arranged to fluidly connect the compression stage and a distal chamber defined by the intermediate casing and the electric motor and comprising the second end winding, and a refrigerant suction inlet emerging in the annular outer volume. The connecting means include at least one refrigerant circulation duct situated outside the intermediate casing, and at least one distal window formed on the intermediate casing and emerging on the one hand in the at least one refrigerant circulation duct and on the other hand in the distal chamber near the second end winding of the stator.

16 Claims, 3 Drawing Sheets

(51) Int. Cl.

| | |
|---|---|
| ***F04C 29/04*** | (2006.01) |
| ***F04C 23/00*** | (2006.01) |
| ***F04C 29/02*** | (2006.01) |
| ***F04C 18/02*** | (2006.01) |
| *F01C 21/10* | (2006.01) |
| *F04C 23/02* | (2006.01) |

(52) U.S. Cl.

CPC ..... *F04C2240/30* (2013.01); *F04C 2240/603* (2013.01); *F04C 2240/809* (2013.01)

SCROLL COMPRESSOR

The present invention relates to a scroll compressor.

U.S. Pat. No. 7,311,501 discloses a scroll compressor, comprising a sealed enclosure containing a compression stage, an electric motor having a stator and rotor, the stator comprising a first end winding turned toward the compression stage, a second end winding opposite the compression stage, and a core positioned between the first and second end windings, an intermediate casing enveloping the stator so as to define an annular outer volume with the sealed enclosure on the one hand, and an inner volume containing the electric motor on the other hand, the intermediate casing comprising a plurality of proximal inlet openings emerging in the inner volume near the first end winding of an electric motor and arranged to put the inner and outer volumes in communication, and a plurality of distal inlet openings emerging in the inner volume near the second end winding of the electric motor and arranged to put the inner and outer volumes in communication, the intermediate casing and the stator defining two refrigerant flow passages, a refrigerant suction inlet emerging in the annular outer volume, and a deflector positioned across from the refrigerant suction inlet, the deflector being arranged to divide the refrigerant flow entering through the refrigerant suction inlet into a first circumferential flow and a second circumferential flow.

The compressor described in document U.S. Pat. No. 7,311,501 is configured such that under usage conditions, the refrigerant flow penetrating the refrigerant suction inlet is divided into two circumferential flows, and such that a first part of each circumferential flow flows through the proximal inlet openings, penetrates the inner volume at the first end winding of the stator, and then flows toward the compression stage, and the second part of each circumferential flow flows through the distal inlet openings, penetrates the inner volume at the second end winding of the stator, and then flows toward the compression stage on the one hand through the flow passages defined by the intermediate casing and the stator, and on the other hand by the functional play existing between the stator and rotor.

Thus, the first part of each circumferential flow makes it possible to cool the first end winding of the stator, while the second part of each circumferential flow makes it possible to cool the second end winding of the stator, the core of the stator and rotor.

The configuration of the compressor described in document U.S. Pat. No. 7,311,501 consequently makes it possible, due to the circulation of refrigerant, to improve the cooling of the electric motor, and therefore the output of the compressor.

However, producing refrigerant flow passages by removing material on the periphery of the stator creates a significant decrease in the performance of the electric motor.

Furthermore, such refrigerant flow passages make the production of the stator more complex, and therefore increase the production costs of the electric motor.

The present invention aims to resolve these drawbacks.

The technical problem at the base of the invention therefore consists of providing a scroll compressor that has a simple and cost-effective structure, while improving the performance of the compressor.

To that end, the present invention relates to a scroll compressor, comprising:

a sealed enclosure containing a compression stage, an electric motor having a stator and a rotor, the stator comprising a first end winding turned toward the compression stage, and a second end winding opposite the compression stage, an intermediate casing in which the electric motor is mounted, the intermediate casing surrounding the stator so as to define an annular outer volume with the sealed enclosure, the intermediate casing and the electric motor at least partially defining a proximal chamber containing the first end winding of the stator and a distal chamber containing the second end winding of the stator, the intermediate casing comprising at least one distal inlet opening emerging in the distal chamber near the second end winding of the stator and arranged to put the outer volume and the distal chamber in communication, connecting means arranged to fluidly connect the distal chamber and the compression stage of the compressor, the connecting means being arranged to guide a refrigerant flow from the distal chamber toward the compression stage, and a refrigerant suction inlet emerging in the annular outer volume, characterized in that the connecting means comprise at least one refrigerant circulation duct situated outside the intermediate casing, and at least one distal window formed on the intermediate casing and emerging on the one hand in the at least one refrigerant circulation duct and on the other hand in the distal chamber near the second end winding of the stator.

Such a configuration of the connecting means makes it possible to guide a refrigerant flow from the distal chamber toward the compression stage, while using a standard stator and intermediate casing that are easy to produce. These arrangements make it possible to reduce the manufacturing costs of the electric motor as well as the electrical resistivity of the stator. This results in reducing the production costs of the compressor, and increasing the performance thereof.

More particularly, the at least one refrigerant circulation duct is arranged to guide a refrigerant flow from the distal chamber toward the compression stage.

According to one feature of the invention, the at least one distal window emerges in the distal chamber at the second end winding of the stator.

Advantageously, the refrigerant circulation duct is mounted on the outer wall of the intermediate casing.

The refrigerant circulation duct is preferably positioned adjacent to the refrigerant suction inlet. The refrigerant circulation duct is for example arranged to divide the refrigerant flow entering through the refrigerant suction inlet into a first circumferential flow and a second circumferential flow. The refrigerant circulation duct thereby forms a deflection member.

According to one embodiment of the invention, the refrigerant circulation duct extends substantially parallel to the axis of the compressor.

According to one embodiment of the invention, the connecting means comprise a plurality of distal windows formed on the intermediate casing.

According to one embodiment of the invention, the sealed enclosure includes a suction volume and a compression volume respectively positioned on either side of a body contained in the sealed enclosure, the connecting means including at least one flow passage formed in the body and arranged to fluidly connect the distal chamber and the compression volume. The at least one flow passage is more particularly arranged to fluidly connect the proximal chamber and the compression volume.

According to a first alternative embodiment of the invention, the connecting means include at least one proximal window formed on the intermediate casing and emerging on the one hand in the at least one refrigerant circulation duct and on the other hand in the proximal chamber near the first end winding of the stator, the at least one refrigerant circulation duct being arranged to guide a refrigerant flow from the at least one distal window toward the at least one proximal window. These arrangements make it possible to divert part of the refrigerant circulating at the second end winding directly toward the first end winding, without that part of the refrigerant coming into contact with the core of the stator and rotor.

According to another feature of the invention, the at least one proximal window emerges in the proximal chamber at the first end winding of the stator. According to one embodiment of the invention, the connecting means comprise a plurality of proximal windows formed on the intermediate casing.

According to a second alternative embodiment of the invention, the at least one refrigerant circulation duct emerges in a flow passage of the body. These arrangements make it possible to divert part of the refrigerant circulating at the second end winding directly toward the compression volume, without that part of the refrigerant coming into contact with the core of the stator and rotor.

Advantageously, the compression stage comprises a fixed volute and a moving volute each comprising a scroll, the scroll of the moving volute being engaged in the scroll of the fixed volute and being driven in an orbital movement, the moving volute bearing against the body separating the compression and suction volumes.

According to one embodiment of the invention, the compressor also includes at least one refrigerant circulation channel situated outside the intermediate casing and comprising an inlet port emerging in the outer volume, and wherein at least one distal inlet opening emerges in the at least one refrigerant circulation channel.

Thus, at least part of the refrigerant penetrating the outer volume through the suction inlet must necessarily flow through the refrigerant circulation channel before flowing through the associated distal inlet opening and penetrating the distal chamber near the second end winding of the stator. As a result, the length of the path of the refrigerant is increased before it penetrates the distal inlet opening associated with the refrigerant circulation channel. These arrangements make it possible to reduce the flow speed of the refrigerant between the suction inlet of the compressor and the inlet port of the refrigerant circulation channel, and to favor the release of oil droplets contained in the refrigerant.

The presence of the refrigerant circulation channel consequently makes it possible to improve the performance of the compressor.

Furthermore, the fact that the distal inlet opening emerges in a refrigerant circulation channel whereof the inlet port is placed carefully prevents, when the compressor is restarted or during transitional phases, any suction phenomenon of liquid refrigerant toward the compression stage. This provides effective protection for the compression stage, and therefore the compressor.

According to one embodiment of the invention, the intermediate casing substantially sealably defines the outer and inner volumes.

According to one embodiment of the invention, the intermediate casing comprises at least one proximal inlet opening emerging in the proximal chamber near the first end winding of the stator and arranged to put the outer volume and proximal chamber in communication.

Preferably, the at least one proximal inlet opening emerges in the proximal chamber at the first end winding of the stator. Preferably, the at least one distal inlet opening emerges in the distal chamber at the second end winding of the stator.

According to one embodiment of the invention, said inlet port of the at least one refrigerant circulation channel is offset from the at least one associated distal inlet opening across from an oil sump of the compressor. Said inlet port is for example offset from the refrigerant suction inlet across from the oil sump of the compressor.

According to one embodiment of the invention, said inlet port is axially offset from the at least one associated distal inlet opening toward the compression stage. The inlet port is advantageously axially offset from the refrigerant suction inlet toward the compression stage.

Said inlet port is for example situated beyond the first end winding of the stator relative to the second end winding.

Advantageously, at least one proximal inlet opening emerges in the at least one refrigerant circulation channel.

According to one embodiment of the invention, each distal inlet opening emerges in a refrigerant circulation channel. Preferably, each proximal inlet opening emerges in a refrigerant circulation channel.

According to one embodiment of the invention, the at least one refrigerant circulation channel is circumferentially offset from the refrigerant suction inlet. The at least one refrigerant circulation channel is for example circumferentially offset from the refrigerant suction inlet by an angle comprised between 90 and 180°, and more particularly between 120 and 180°.

Advantageously, the at least one refrigerant circulation channel, the at least one proximal inlet opening and the at least one distal inlet opening are configured such that the refrigerant flow rate passing through the at least one proximal inlet opening represents 40 to 60% of the refrigerant flow rate passing through the refrigerant suction inlet, and the refrigerant flow rate passing through the at least one distal inlet opening represents 40 to 60% of the refrigerant flow rate passing through the refrigerant suction inlet.

Preferably, the at least one refrigerant circulation channel is mounted on the outer wall of the intermediate casing. The at least one refrigerant circulation channel for example extends substantially parallel to the axis of the compressor.

The at least one proximal inlet for example has a passage section smaller than that of the at least one distal inlet opening. When the intermediate casing comprises a plurality of proximal inlet openings and a plurality of distal inlet openings, the proximal inlet openings have a total passage cross-section smaller than that of the distal inlet openings.

According to one embodiment of the invention, the compressor comprises a plurality of refrigerant circulation channels circumferentially offset from one another and a plurality of distal inlet openings, and at least one distal inlet opening emerges in each refrigerant circulation channel.

Preferably, the or each distal inlet opening emerges in a refrigerant circulation channel.

Preferably, the or each proximal inlet opening emerges in a refrigerant circulation channel.

Preferably, the compressor includes a centering part fixed on the sealed enclosure, the end of the intermediate casing across from the compression stage being substantially sealably covered by the centering part. Preferably, the end of the intermediate casing across from the compression stage rests on the central part. The centering part is advantageously provided with a guide bearing for an end portion of the drive shaft secured in rotation to a moving volute of the compression stage.

According to one embodiment of the invention, the scroll compressor is a variable capacity compressor, and more particularly a variable speed compressor. According to another embodiment of the invention, the scroll compressor is a fixed capacity compressor, and more particularly a fixed speed compressor.

In any event, the invention will be well understood using the following description done in reference to the appended diagrammatic drawing, which shows, as non-limiting examples, two embodiments of this scroll refrigeration compressor.

Figure 1:
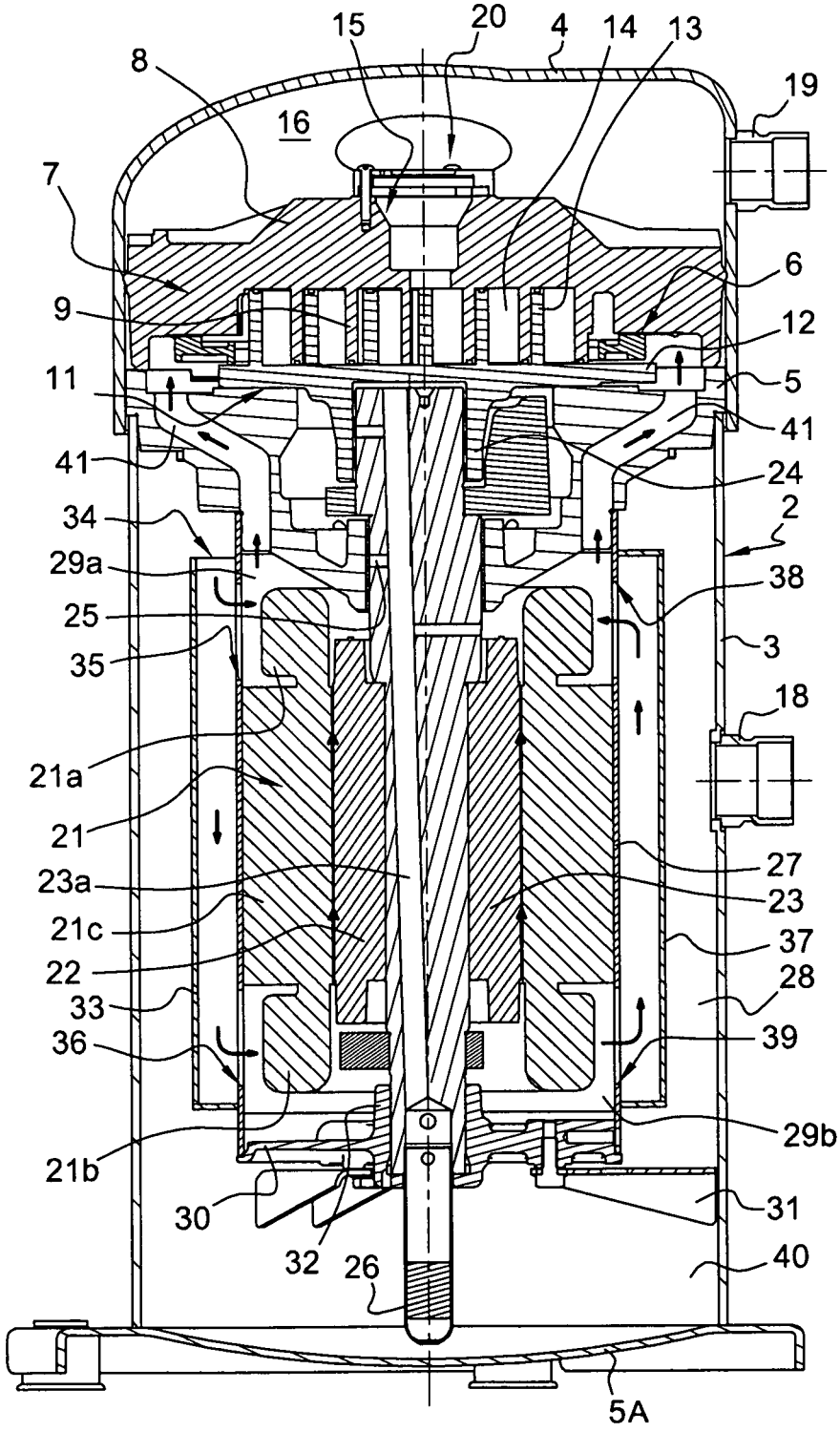
FIG. 1 is a longitudinal cross-sectional view of a scroll refrigeration compressor according to a first embodiment of the invention.
Figure 2:
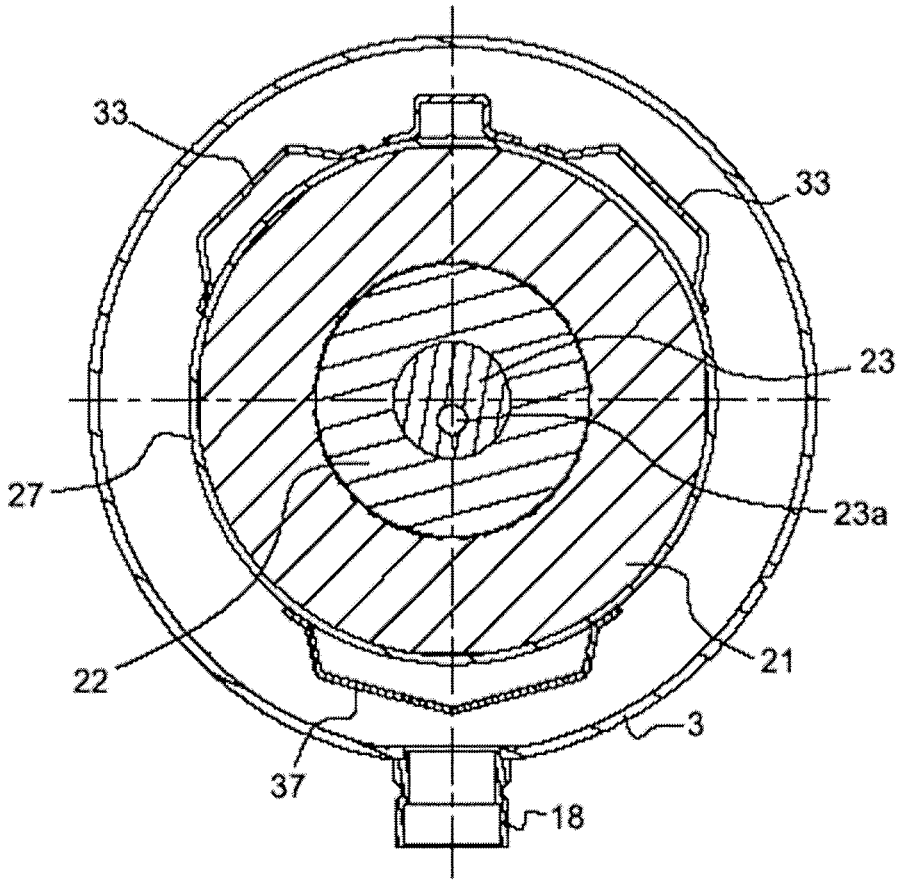
FIG. 2 is a transverse cross-section of the compressor of FIG. 1.

FIGS. 1 and 2 describe a scroll refrigeration compressor according to a first embodiment of the invention, in a vertical position. However, this compressor could be in an inclined position, or in a horizontal position, without its structure being modified significantly.

The compressor shown in FIGS. 1 and 2 comprises a sealed enclosure 2 defined by a shell 3 whereof the upper and lower ends are respectively closed by a lid 4 and a base 5A. The assembly of the sealed enclosure 2 may in particular be done using weld seams.

The intermediate part of the compressor is occupied by a body 5 that defines two volumes, a suction volume situated below the body 5, and a compression volume positioned above the body. The body 5 is used to mount a compression stage 6 for the refrigerant. This compression stage 6 comprises a fixed volute 7 comprising a plate 8 from which a fixed scroll 9 extends turned downward, and a moving volute 11 including a plate 12 bearing against the body 5 and from which a scroll 13 extends turned upward. The two scrolls 9 and 13 of the two volutes are interleaved to form variable volume compression chambers 14.

The compressor also comprises a discharge duct 15 formed in the central part of the fixed volute 7. The discharge duct 15 comprises a first end emerging in the central compression chamber and a second end designed to be put in communication with a high-pressure discharge chamber 16 formed in the enclosure of the compressor. The discharge chamber 16 is delimited by the plate 8 of the fixed volute 7 and the lid 4.

The compressor also comprises a refrigerant suction inlet 18 emerging in the suction volume to bring refrigerant into the compressor, and a discharge outlet 19 emerging in the discharge chamber 16.

The compressor also comprises a non-return device 20 mounted on the plate 8 of the fixed volute 7 at the second end of the discharge duct 15, and in particular including a check valve movable between a covering position preventing the discharge duct 15 and the discharge chamber 16 from being put in communication, and a released position allowing the discharge duct 15 and the discharge chamber 16 to be put in communication. The check valve is designed to be moved in its released position when the pressure in the discharge duct 15 exceeds the pressure in the discharge chamber 16 by a predetermined value substantially corresponding to the adjustment pressure of the discharge valve.

The compressor comprises an electric motor positioned in the suction volume. The electric motor comprises a stator 21, at the center of which a rotor 22 is positioned. The stator 21 comprises a first end winding 21*a* turned toward the compression stage, a second end winding 21*b* opposite the compression stage, and a core 21*c* positioned between the first and second end windings 21*a*, 21*b*. The rotor 22 is secured to a drive shaft 23 whereof the upper end is out of alignment, like a crankshaft. This upper portion is engaged in a sleeve 24 of the moving volute 11. Thus, when it is rotated by the motor, the drive shaft 23 drives the moving volute 11 in an orbital movement. The drive shaft 23 comprises a lubrication duct 23*a* formed in its central portion. The lubrication duct 23*a* is out of alignment and preferably extends over the entire length of the drive shaft 23. The drive shaft 23 also comprises at least one lubrication port 25 respectively emerging on the one hand in the lubrication duct 23*a* and on the other hand in the outer surface of the driveshaft.

The compressor also comprises an oil pump 26 housed in the lower portion of the sealed enclosure. The oil pump 26 is rotationally coupled to the lower end of the drive shaft 23, and is arranged to supply the lubrication duct 23*a* with oil from oil contained in an oil sump 40 partially defined by the base 5A and the shell 3.

The compressor also comprises an intermediate casing 27 enveloping the stator 21. The upper end of the intermediate casing 27 is fixed on the body 5 separating the suction and compression volumes, such that the intermediate casing 27 is used to fasten the electric motor. The intermediate casing 27 and the sealed enclosure 2 define an annular outer volume 28 in which the refrigerant suction inlet 18 emerges. The intermediate casing 27 and the electric motor partially define a proximal chamber 29*a* containing the first end winding 21*a* of the stator 21 and a distal chamber 29*b* containing the second end winding 21*b* of the stator 21.

The compressor also comprises a centering part 30, fixed on the sealed enclosure using a fastening part 31, provided with a guide bearing 32 arranged to guide the lower end portion of the drive shaft 23. The lower end of the intermediate casing 27 rests on the centering part 30 such that the centering part 30 substantially sealably covers the lower end of the intermediate casing 27.

The compressor also includes two refrigerant circulation channels 33 situated outside the intermediate casing 27, and circumferentially offset from the refrigerant suction inlet 18. Each refrigerant circulation channel 33 is for example circumferentially offset from the refrigerant suction inlet by an angle comprised between 90 and 180°, more particularly between 120 and 180°, and for example approximately 135°.

Preferably, each refrigerant circulation channel 33 is formed by a plate mounted on the outer wall of the intermediate casing 27, and extends substantially parallel to the axis of the compressor.

Each refrigerant circulation channel 33 comprises an inlet port 34 emerging in the outer volume 28. The inlet port 34 of each refrigerant circulation channel 33 is axially offset from the refrigerant suction inlet 18 toward the compression stage 6, and is preferably situated beyond the first end winding 21*a* of the stator 21 relative to the second end winding 21*b*.

The intermediate casing 27 comprises two proximal inlet openings 35 emerging in the proximal chamber 29*a* at the first end winding 21*a* of the stator 21 and are arranged to put the outer volume 28 and the proximal chamber 29*a* in communication. Preferably, each proximal inlet opening 35 emerges in one of the refrigerant circulation channels 33 near the inlet port 34 of said channel.

The intermediate enclosure 27 also comprises two distal inlet openings 36 emerging in the distal chamber 29*b* at the second end winding 21*b* of the stator 21 and arranged to put the outer volume 28 and the distal chamber 29*b* in communication. Each distal inlet opening 36 emerges in one of the refrigerant circulation channels 33 near the end of said channel across from the compression stage 6.

According to one alternative embodiment of the invention shown in FIG. 1, the proximal and distal inlet openings 35, 36 have identical passage cross-sections. According to another alternative embodiment of the invention, the proximal inlet openings 35 may have passage cross-sections smaller than those of the distal inlet openings 36.

Preferably, the refrigerant circulation channels 33, the proximal inlet openings 35 and the distal inlet openings 36 are configured such that the refrigerant flow rate passing through the proximal inlet openings 35 represents 40 to 60% of the refrigerant flow rate passing through the refrigerant suction inlet 18, and the refrigerant flow rate passing through the distal inlet openings 36 represents 40 to 60% of the refrigerant flow rate passing through the refrigerant suction inlet 18.

The compressor also comprises connecting means arranged to fluidly connect the distal chamber 29*b* and the compression stage 6 of the compressor.

The connecting means include a refrigerant circulation duct 37 situated outside the intermediate casing 27 and advantageously positioned adjacent to the refrigerant suction inlet 18. The refrigerant suction duct 37 extends substantially parallel to the axis of the compressor, and is formed by a plate mounted on the outer wall of the intermediate casing 27.

Advantageously, the refrigerant circulation duct 37 is arranged to divide the refrigerant flow entering through the refrigerant suction inlet 18 into a first circumferential flow and a second circumferential flow. The refrigerant circulation duct 37 thus forms a deflection member.

The connecting means also include two proximal windows 38 formed on the intermediate casing 27 and emerging on the one hand in the refrigerant circulation duct 37 and on the other hand in the proximal chamber 29*a* at the first end winding 21*a* of the stator 21, and two distal windows 39 formed on the intermediate casing 27 and emerging on the one hand in the refrigerant circulation duct 37 and on the other hand in the distal chamber 29*b* at the second end winding 21*b* of the stator 21. The refrigerant circulation duct 37 is more particularly arranged to guide a refrigerant flow from the distal windows 39 to the proximal windows 38. The proximal and distal windows 38, 39 preferably have substantially identical passage cross-sections.

The connecting means also include flow passages 41 formed in the body 5 and arranged to fluidly connect the proximal chamber 29*a* and the compression volume. Each flow passage 41 emerges on the one hand in the proximal chamber 29*a* and on the other hand in the compression volume.

The compressor according to the invention is preferably configured such that under usage conditions, the refrigerant flow penetrating the refrigerant suction inlet 18 is divided into two circumferential flows by the refrigerant circulation duct 37, and such that part of each circumferential flow flows through the inlet opening 34 of each refrigerant circulation channel 33. A first part of the refrigerant flow having penetrated each refrigerant circulation channel 33 flows through the respective proximal inlet opening 35, penetrates the proximal chamber 29*a* at the first end winding 21*a* of the stator 21, and flows toward the compression stage 6 through the flow passages 41 formed in the body 5. The second part of the refrigerant having penetrated each refrigerant circulation channel 33 flows along said channel and through the respective distal inlet opening 36, penetrates the distal chamber 29*b* at the second end winding 21*b* of the stator 21, and flows toward the compression stage on the one hand via the distal windows 39, the refrigerant circulation duct 37, the proximal windows 38 and the flow passages 41 formed in the body 5, and on the other hand via the air gap existing between the stator 21 and the rotor 22 and the flow passages 41 formed in the body 5.

Figure 3:
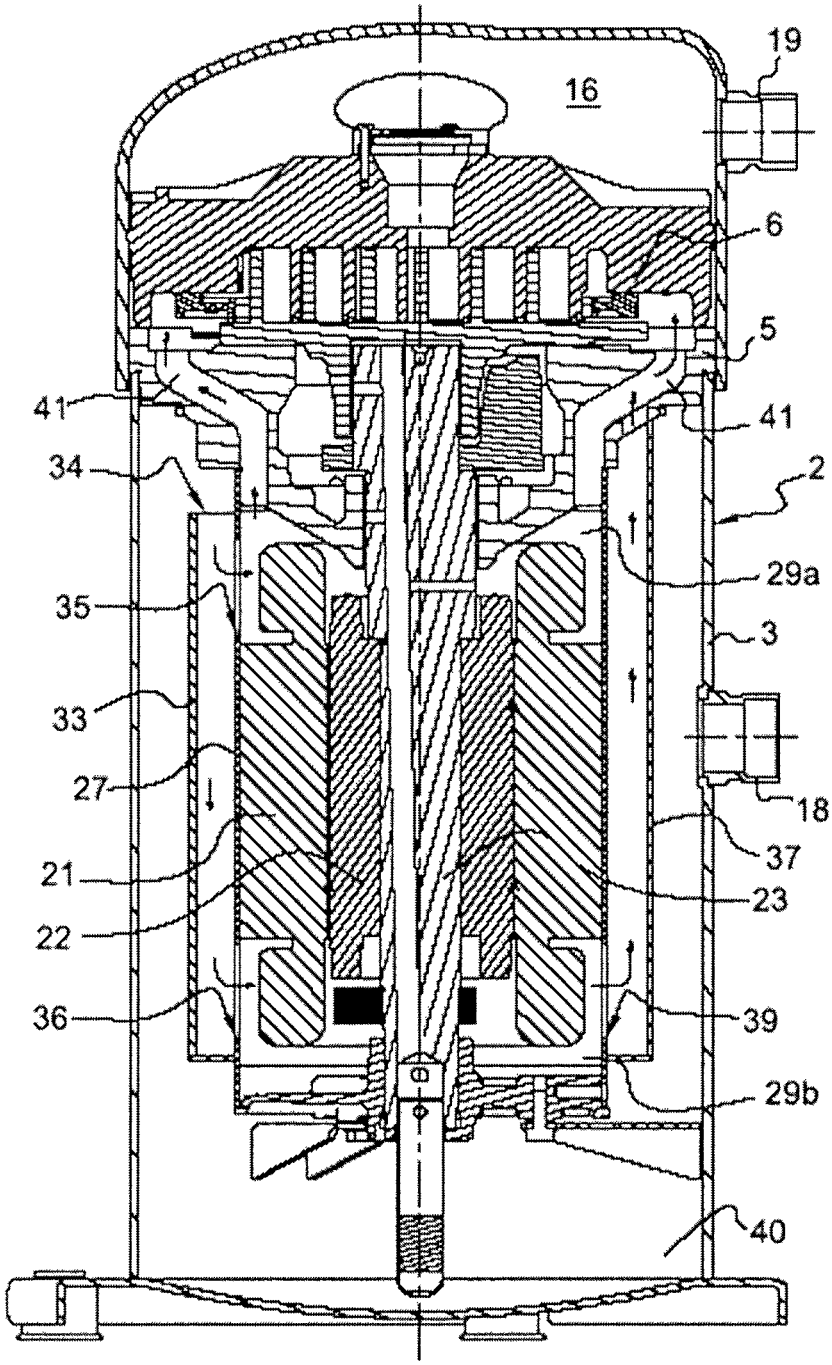
FIG. 3 is a longitudinal cross-sectional view of a scroll refrigeration compressor according to a second embodiment of the invention.

FIG. 3 shows a compressor according to a second embodiment of the invention that differs from that shown in FIGS. 1 and 2 essentially in that the intermediate casing 27 does not have proximal windows 38, and in that the end of the refrigerant circulation duct 37 across from the distal windows 39 emerges in one of the flow passages 41 of the body 5.

The invention is of course not limited solely to the embodiments of this scroll compressor described above as examples, but on the contrary encompasses all alternative embodiments.

The invention claimed is:

1. A scroll compressor, comprising:

a sealed enclosure containing a compression stage and an electric motor having a stator and a rotor, the electric motor being positioned in a suction volume defined within the sealed enclosure, the stator comprising a first end winding turned toward the compression stage, and a second end winding opposite the compression stage, an intermediate casing in which the electric motor is mounted, the intermediate casing surrounding the stator so as to define an annular outer volume with the sealed enclosure, the intermediate casing and the electric motor at least partially defining a proximal chamber containing the first end winding of the stator and a distal chamber containing the second end winding of the stator, the intermediate casing comprising at least one distal inlet opening emerging in the distal chamber near the second end winding of the stator and arranged to put the outer volume and the distal chamber in communication, and connecting device arranged to fluidly connect the distal chamber and the compression stage of the compressor, the connecting device being arranged to guide a refrigerant flow from the distal chamber toward the compression stage, the connecting device comprising at least one refrigerant circulation duct situated outside the intermediate casing and located in the annular outer volume, and at least one distal window formed on the intermediate casing near the second end winding of the stator and emerging in the at least one refrigerant circulation duct, the at least one distal window being configured to fluidly connect the distal chamber and the at least one refrigerant circulation duct, and a refrigerant suction inlet emerging in the annular outer volume.

2. The compressor according to claim 1, wherein the at least one refrigerant circulation duct is mounted on the outer wall of the intermediate casing.

3. The compressor according to claim 1, wherein the at least one refrigerant circulation duct is positioned adjacent to the refrigerant suction inlet.

4. The compressor according to claim 3, wherein the refrigerant circulation duct is arranged to divide the refrigerant flow entering through the refrigerant suction inlet into a first circumferential flow and a second circumferential flow.

5. The compressor according to claim 1, further comprising a body contained in the sealed enclosure, wherein the sealed enclosure includes a suction volume and a compression volume respectively positioned on either side of the body contained in the sealed enclosure, at least one flow passage being formed in the body and being arranged to fluidly connect the distal chamber and the compression volume.

6. The compressor according to claim 5, wherein the at least one refrigerant circulation duct emerges in a flow passage of the body.

7. The compressor according to claim 1, wherein the connecting device includes at least one proximal window formed on the intermediate casing and emerging on the one hand in the at least one refrigerant circulation duct and on the other hand in the proximal chamber near the first end winding of the stator, the at least one refrigerant circulation duct being arranged to guide a refrigerant flow from the at least one distal window toward the at least one proximal window.

8. The compressor according to claim 1, wherein the intermediate casing comprises at least one proximal inlet opening emerging in the proximal chamber near the first end winding of the stator and arranged to put the outer volume and proximal chamber in communication.

9. The compressor according to claim 8, wherein the at least one proximal inlet opening has a passage cross-section smaller than that of the at least one distal inlet opening.

10. The compressor according to claim 1, wherein the compressor further includes at least one refrigerant circulation channel situated outside the intermediate casing, the at least one refrigerant circulation channel comprising an inlet port emerging in the outer volume, and wherein at least one distal inlet opening is configured to fluidly connect the at least one refrigerant circulation channel and the distal chamber.

11. The compressor according to claim 10, wherein said inlet port is offset from the refrigerant suction inlet across from an oil sump of the compressor.

12. The compressor according to claim 10, wherein said inlet port is situated beyond the first end winding of the stator relative to the second end winding.

13. The compressor according to claim 10, wherein the at least one refrigerant circulation channel is circumferentially offset from the refrigerant suction inlet.

14. The compressor according to claim 10, wherein the at least one refrigerant circulation channel is mounted on the outer wall of the intermediate casing.

15. The compressor according to claim 10, wherein the at least one refrigerant circulation channel, the at least one proximal inlet opening and the at least one distal inlet opening are configured such that the refrigerant flow rate passing through the at least one proximal inlet opening represents 40 to 60% of the refrigerant flow rate passing through the refrigerant suction inlet, and the refrigerant flow rate passing through the at least one distal inlet opening represents 40 to 60% of the refrigerant flow rate passing through the refrigerant suction inlet.

16. The compressor according to claim 10, wherein at least one proximal inlet opening emerges in the at least one refrigerant circulation channel.

* * * * *